United States Patent [19]

Griffin

[11] 4,280,307

[45] Jul. 28, 1981

[54] PRE-ENGINEERED CONSTRUCTION SYSTEM UTILIZING PREFABRICATED MEMBERS

[76] Inventor: Alphonso Griffin, 2625 Hemple St., Chesapeake, Va. 23324

[21] Appl. No.: 20,338

[22] Filed: Mar. 14, 1979

[51] Int. Cl.[3] ..... E04B 7/00

[52] U.S. Cl. ..... 52/90; 52/580; 52/274; 52/275; 52/582

[58] Field of Search ..... 52/463, 90–94, 52/274, 275, 580, 584

[56] References Cited

U.S. PATENT DOCUMENTS

| | | | |
|---|---|---|---|
| 3,462,897 | 8/1969 | Weinrott | 52/90 |
| 3,500,597 | 3/1970 | McKenzie | 52/94 |
| 3,793,789 | 2/1974 | Greenamyer | 52/463 |
| 3,992,829 | 11/1976 | Schellberg et al. | 52/580 |

*Primary Examiner*—James L. Ridgill, Jr.
*Attorney, Agent, or Firm*—Clay Holland, Jr.

[57] ABSTRACT

An improved construction system disclosed herein comprises a plurality of pre-engineered panalized or sectionalized building elements and units designed and prefabricated to include all of the basic services such as wiring, plumbing, ductwork, and the like, and materials in the form of framing structures with finished walls, flooring and ceilings adopted for ease of transport, assembly, disassembly and reassembly in accordance with flexible erection and construction processes. Each prefabricated panel or unit includes as an integral part of its structure a mechanical interconnection and interlocking means for fixedly joining each with one or more other panels along one or more preselected edge regions thereof. The interconnecting and interlocking mechanisms include a combination of architecturally sound arrangements of one or more connector plates, supporting and positioning blocks, girders or bearing plates and the like. These architecturally sound interconnecting and interlocking devices are pre-engineered and designed such that they are adaptable to meet the building code requirements of the specific community where the building is to be located. Each panel or unit is completed by having its exposed surfaces finished, and with the required utility service lines, such as wiring, plumbing, heating and the like, fashioned within the interior of the panels for mechanical, electrical and the like interconnections therebetween to provide a completely integrating utility service system when subsequently connected to incoming commercial utility supplies.

7 Claims, 18 Drawing Figures

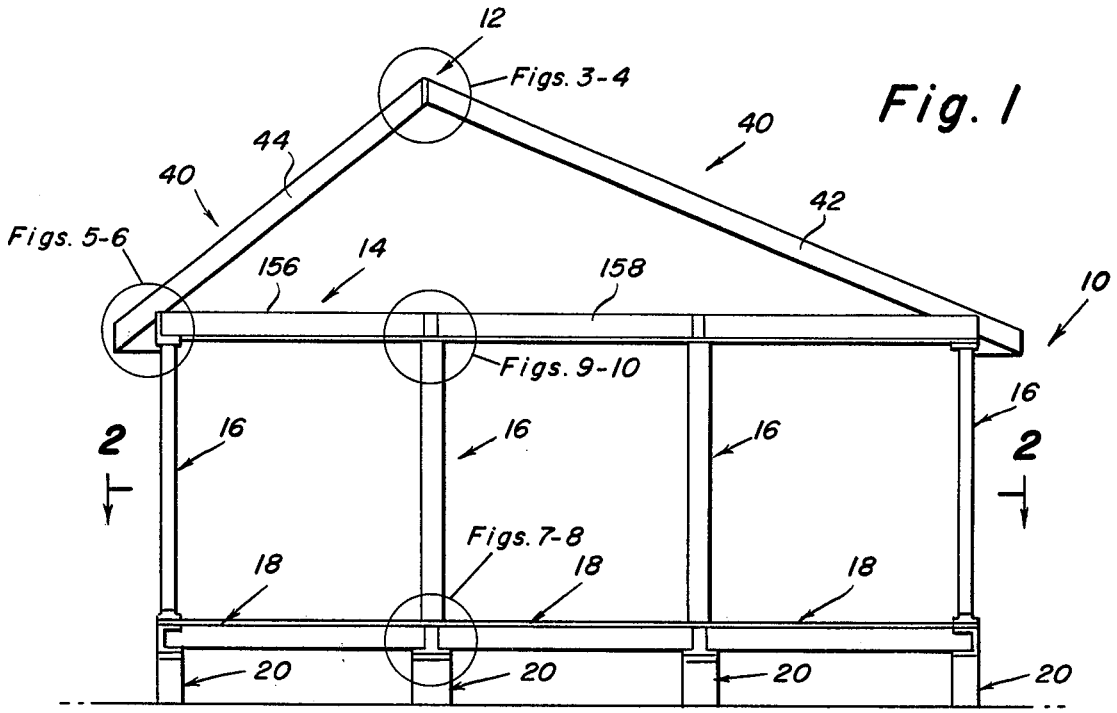
Fig. 1
Fig. 2
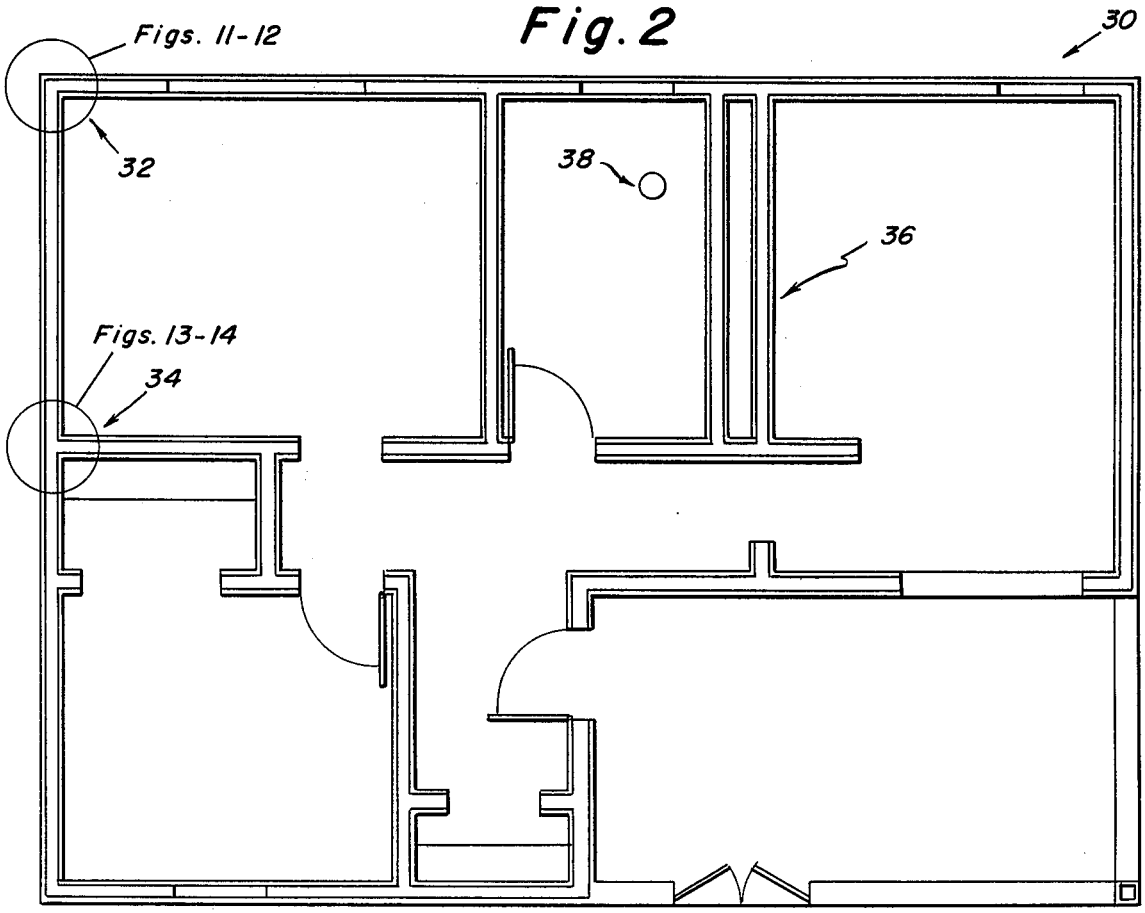

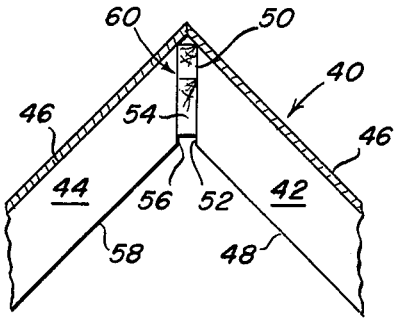
Fig. 3
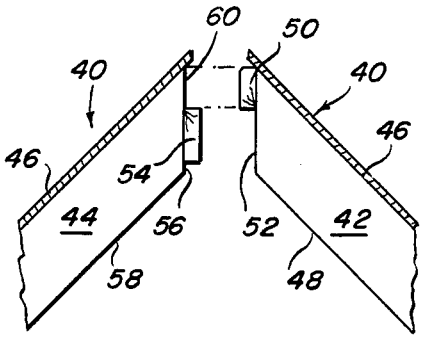
Fig. 4
Fig. 5
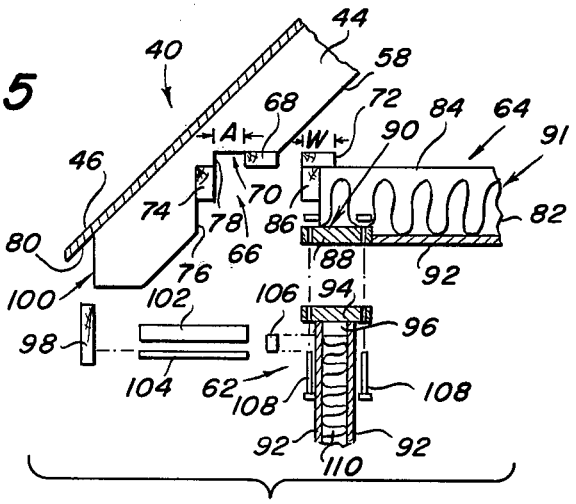
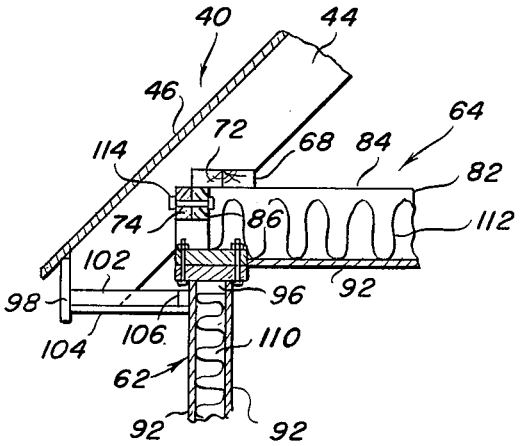
Fig. 6

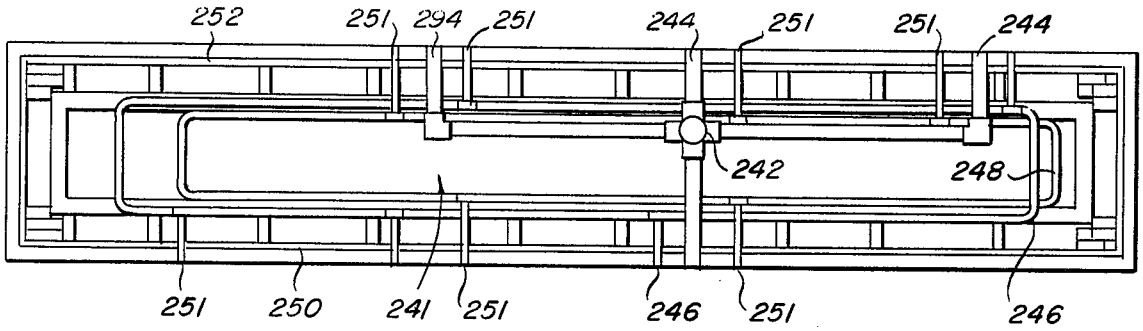
Fig. 15
Fig. 16
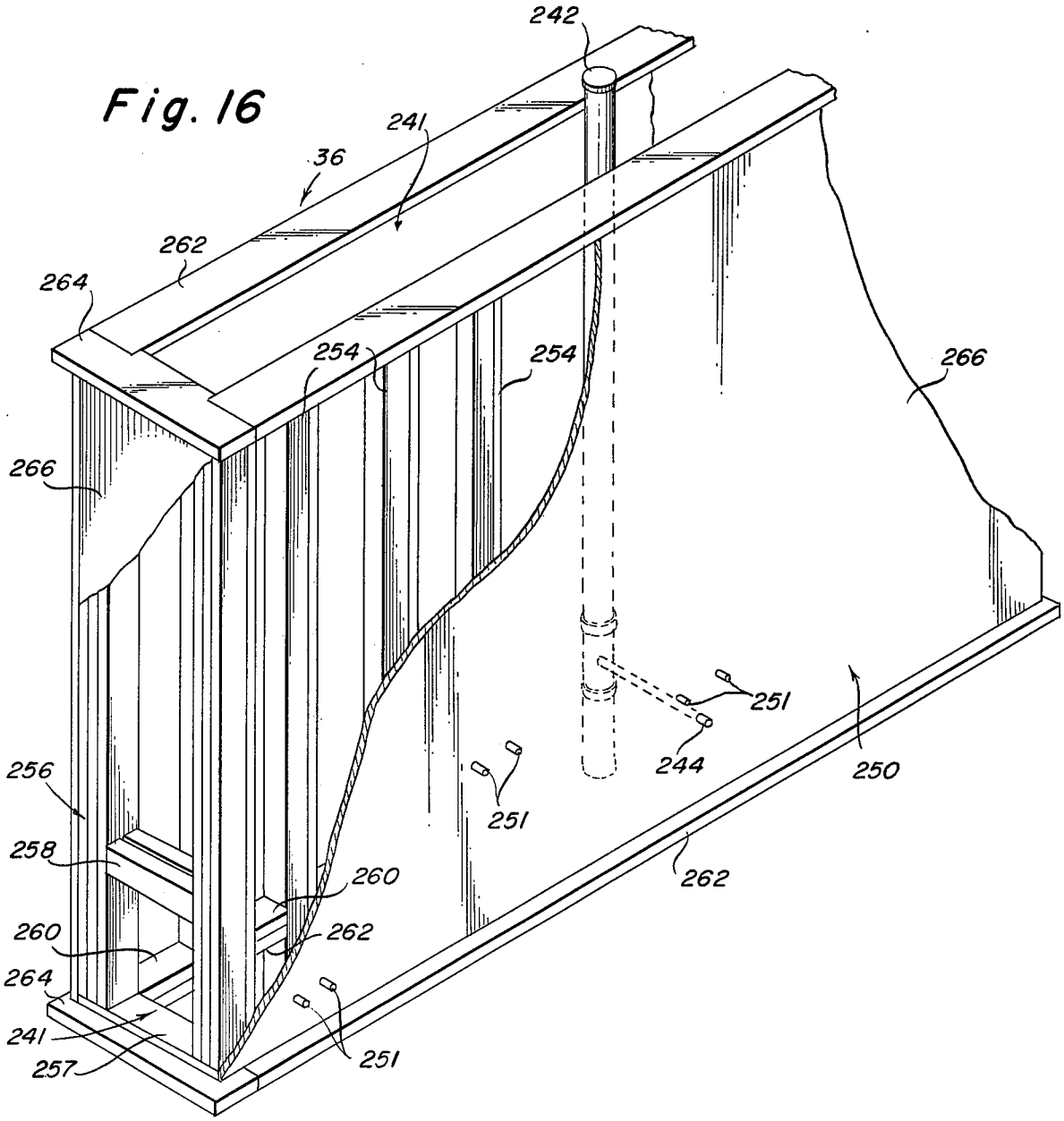

PRE-ENGINEERED CONSTRUCTION SYSTEM UTILIZING PREFABRICATED MEMBERS

BACKGROUND OF THE INVENTION

The present invention relates to an improved pre-engineered building construction system and more particularly to a building construction system which utilizes improved prefabricated panelized or sectionalized system units which are designed and constructed off-site to include all of the basic utility services, materials and functional elements of contemporary and traditional buildings when erected and assembled to preselected plans and in accordance with a predetermined assembly process. The necessity for innovative reasonably priced and socially responsive housing for all people is recognized in almost every community today. However, owing to the prolonged escalation of building costs resulting from inflation, even the average and other citizens are being denied the possible opportunity of realizing the American dream of home ownership. With the foregoing circumstance in mind, the present invention is directed toward alleviating the problem by providing a unique construction system for building housing which includes all the basic services and structural features of contemporary housing at an economical cost.

It is known heretofore, in the building construction industry, how to fabricate certain components of a building structure, such as walls, floors, roof trusses and the like, at a centrally located factory and then to transport these components to a building site where they are assembled and erected on a prepared foundatin to complete a building structure. It is also known in the prior construction art, that a central module including the complete kitchen, bathroom, closets and other closets with the utilities necessary for such rooms can be built off-site for incorporating into the building.

Various patents have been issued on the construction of buildings with prefabricated panel elements such as walls, floors, and the like in factories located remote from the building site for erection at such sites. Such patents are U.S. Pat. Nos. 4,071,984, 4,040,227 and 3,492,767. While U.S. Pat. No. 3,862,534 is directed toward a central room, forming the heart of the finished building, including a kitchen, bathroom, or closets, and all utilities necessary for the building; U.S. Pat. No. 3,919,812 is directed toward structural means and methods for erecting and interconnecting various building sections to one another to complete the building. However, none of these construction approaches, individually or in combination with one another, have provided the needed innovative and socially responsible system which meets the services, materials or functional features of contemporary and traditionally desired buildings as dwellings at an economical cost affordable by the masses.

The prior art systems have failed to meet the needs and demands for economical, functional and architecturally sound buildings because they have overlooked a basic concept long known in the architectural-engineering art. It is well known that a structural need not be complicated and costly to build, to be functionally and aestheically sound. Stated differently, "the form follows the function". Thus, a simplified form is adequate, provided it meets the required architectural-engineering specification or requirements of design.

Thus, the prior art prefabricated construction systems have strayed somewhat from the basics, and have attempted to utilize elaborate materials such as aluminum, epoxies, light weight concrete re-inforced with styrene, etc. Working with these materials and utilizing techniques necessary to fabricate elements of a building and assemble the same, requires skilled technicians, and, costly and complicated equipment and tools to effectuate the job. Stated in another way, the construction industry has failed to appreciate and fully utilize the basic building blocks of its industry to their best advantage.

The present invention has capitalized on this apparent oversight and has incorporated sound architectural-engineering principals and practices into the old building blocks to thereby create a novel design wherein "the form follows the function." That is, the final format of the mechanical interconnections and interlocking devices for assembling building structures have been engineered and designed such that when they are placed or joined in fixed position to produce joints, connections and the like that will meet the building code requirements of a community and are architecturally and engineeringly safe and sound.

Since they are created in a simplified format and can utilize readily available materials well known and extensively used in the construction industry, the cost for the prefabrication of panels and mechanism for interconnections is low. In addition less skilled labor can be used to assemble the building structures owning to the simplicity and ease with which the job can be accomplished, in accordance with the present invention.

STATEMENT OF INVENTION

In accordance with the present invention a pre-engineered construction system of prefabricate panelized and sectionalized members and components that conform more exactly in a repetitious manner to structural configuration and function having aesthetic appearance beyond that of conventional construction and prefabricated buildings is disclosed. As used hereinafter in the specification and claims the phrase "exact-frame" may be used to encompass various embodiments of the present invention. Further, as used hereinafter in the specification and claims a "connector plate" means a member for mechanical and/or physical support and interconnection between two or more framing members or panels which are defined or required by architectural design or engineering specification or building code requirements of a particular locale of a building construction site.

Other forms of support or interconnecting or interlocking mechanisms or devices compatable with the various panel members have been described or defined in accordance with the concepts of the present inventions such that they may be characterized as "the form that follows the function". It will be readily recognized by those versed in the architectural-engineering art that the phrase "the form follows the function" is used in said art to signify that the form adopted to perform a required function may have a wide range of satisfactory configurations in order to fulfill the desired or required design functions. Consequently, several embodiments of the present invention which operate to rigidly secure panels in fixed spaced relationship one to another are expressed and/or depicted as having varying configurations while conforming with the spirit, concepts and objects of the present invention.

In one embodiment of the present invention, pre-engineered panel members are prefabricated for assembly, disassembly and reassembly on a building site with prepared foundation. Each of the panels utilized in the construction system of this embodiment are designed with devices such as connector plates, supporting and positioning blocks, studs and stud connector plates, key and lock boards and blocks, girders or bearing plates as integral parts of the adjoining edge region of the panels at appropriate locations having pre-engineered configurations for interconnective relationship with one or more other panels which have complementary devices for forming an architectually and engineeringly sound connection or joint there between.

In another embodiment of the present invention one or more of the panels are prefabricated with the facilities for utility services, as may be required for a bathroom or kitchen. Such panels are hereinafter referred to as an utility core or module and may be slightly wider than nonutility panels. The outlet connections or terminals for the various services may be brought through the walls or ends of the module. Those brought through panel walls are usually for connections to toilet and kitchen fixtures, while those brought through the ends of the panel are for interconnection with other service connections of other panels.

In still another embodiment of the present invention allowance for expansion of a building structure is provided for through planned additions owing to the flexibility of the construction system and the ease with which a structure can be disassembled and reassembled during the process of expansion provided it is done as part of a planned expansion.

In still a further embodiment of the present invention each panel is prefabricated with the wiring, heating and air conditioning ducts or pipes disposed within the interior of each panel. At predetermined locations along narrow edges of the panel provisions are made for interconnecting the wiring, heating and air conditioning facilitied of the various panel to provide the desired services to the various rooms of the building.

In yet another embodiment of the present invention provisions are made for interconnecting the wiring, heating and air conditioning facilitied of the various panel to provide the desired services to the various rooms of the building.

In yet another embodiment of the present invention provisions are made for providing insulation within each panel. Such insulation is provided for purposes of temperature and sound insulation. All perimeter panel such as exterior, floor, ceiling and roof panels may be prefabricated with such insulation features.

Thus, the present invention provides a construction system wherein floors, walls, ceilings, roof and the like have been architecturally designed in panels and modules so as to allow for ease of transportation, assembly, disassembly and reassembly of a building by utilizing unique forms and configuration of interconnecting and interlocking devices and arrangements within such design which yields an architectural-engineered structure that meets code requirements and architectural design criteria and specifications.

BRIEF DESCRIPTION OF THE DRAWINGS

The novel features which are believed to be characteristic of the invention both as to its organization and method of construction, together with further objects and advantages thereof, will be better understood from the following description considered in connection with the accompanying drawings in which several embodiments of the invention are illustrated by way of example. It is to be expressly understood, however, that the drawings are for purpose of illustration and description only and are not intended as a definition of the limits of either the articles or methods of construction of the invention.

FIG. 1 is a diagrammatic transverse sectional view of a single story house illustrating the manner in which the various panel components may be assembled to form a building structure in accordance with the present invention;

FIG. 2 is a horizontal cross-sectional view of the same house shown in FIG. 1, taken along line 2—2, illustrating the house floor plan;

FIG. 3 is a fragmentary section of the roof shown in FIG. 1, illustrating the details of the construction and assembly of a house roof at the ridge thereof;

FIG. 4 is the same fragmentary section of the roof shown in FIG. 3 where the roof panels are shown disassembled;

FIG. 5 is the same fragmentary view of the house shown in FIG. 1 except that the elements of figure are disassembled;

FIG. 6 is another fragmentary view of the house shown in FIG. 1, illustrating the details of the construction and assembly connections between a roof, ceiling, and wall panels;

FIG. 15 is a plan view of a utility core or module of the house shown in FIG. 2 illustrating the construction thereof and to the presence of typical pipes as part of the plumbing arrangement;

FIG. 16 is an isometric view of the utility panel shown in FIG. 15 illustrating in greater detail the construction of the framework for the utility core or module as contrasted to the construction of other narrower panels;

Figure 7:
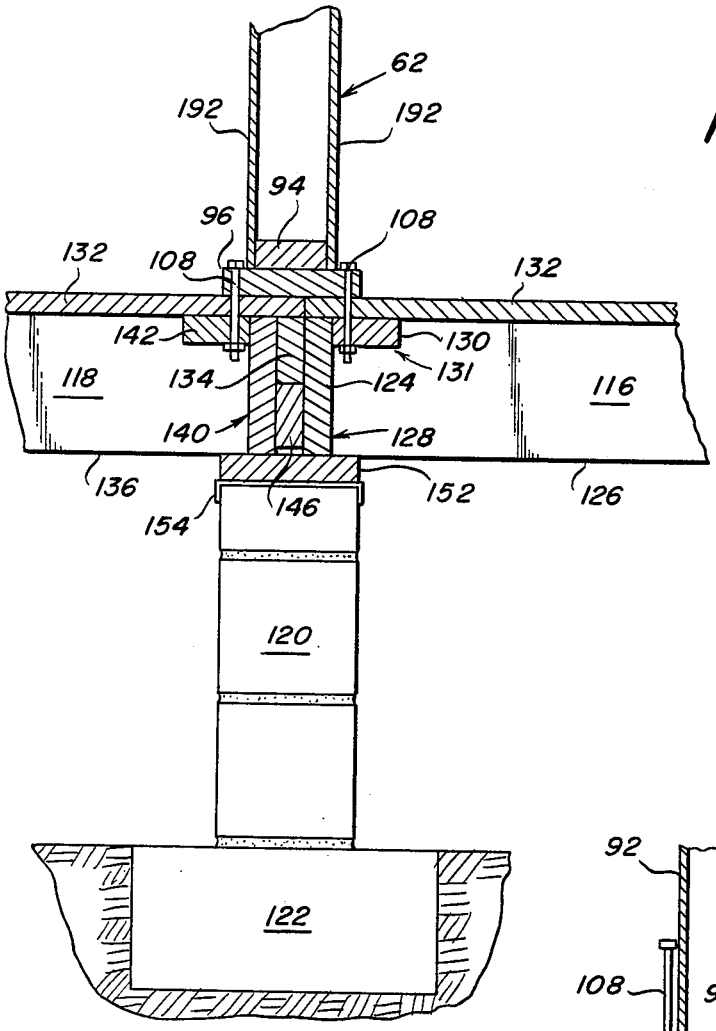
FIG. 7 is a fragmentary view of the house shown in FIG. 1, illustrating the assembled connection of two floor panels and a wall panel.

With reference now to the drawings, wherein like or corresponding parts may be designated by the same reference characters throughout the several views, there is shown in FIG. 1 a house 10. As shown house 10 comprises a roof 40 including panels 42 and 44 which are connected at one point along their length to form an apex 12 of the roof. A plurality of ceiling panels such as whose designated 156 and 158 form a ceiling 14 which covers the entire interior of the house. The house includes a plurality of wall panels generally designated by reference character 16, and a plurality of floor panels generally designated by reference character 18, which extend the full length and width of the house. The essential structural components of the house 10 are completed by the presence of the foundation members generally designated 20.

The house is assembled with roof 40 being supported by the upper portion of the exterior walls 16 at both ends of the house in conjunction with the ceiling panel members at each end of the house at the upper portions of the walls. A portion of the weight of both the roof panels and the ceiling panels is carried by the floor panels and foundation, and such weight is transmitted thereto through the various exterior and interior partition walls.

It is to be understood that the design of a house such as that shown in FIG. 1 has been architecturally engineered to a criteria and specification consistant with the building code requirements of a community where housing site is to be located.

Also shown in FIG. 1 are four encircled fragmentary areas of the house which have been designated 3–4, 5–6, 7–8 and 9–10. The fragmentary designated represent sections of the house which will be enlarged and discussed as FIGS. 3 through 10.

Referring now to FIG. 2 there is shown a floor plan 22 illustrating such plan as it would be seen if taken along lines 2—2 of FIG. 1. As shown in FIG. 2, the floor plan appears as any conventional plan and is illustrative of the scope and flexibility of the system disclosed by this invention. In FIG. 2, a corner connection between two abutting walls 184 and 186, generally designated 32 are shown within the encircled area designated 11–12. The connection between three wall sections generally designated 34 is shown in a second encircled area designated 13–14. These two fragmentary areas of the house shown in FIGS. 1 and 2 will be enlarged as FIGS. 11 through 14 and will be discussed hereinbelow in greater detail with reference thereto.

Referring to the drawings, FIG. 3 is a fragmentary section of the house shown in FIG. 1 and illustrates a detail view of a typical completed roof panel connection of a ridge assembly while FIG. 4 shows the same structure disassembled. As shown in FIG. 4 roof 40 includes two roofing panels 42 and 44. As shown, panel 42 includes an exterior sheating material 46 such as plywood, for an example, a plurality of rafter members 48 which extend the length of said panel 42 and are substantially parallel to one another and which are fastened together by said exterior sheating 46 and an upper roof ridge connector plate 50 which extends along the length of the panel and is fixedly connected to said plurality of rafter members 48 of the panel section. The upper ridge connector plate 50 extends along an edge 52 of said plurality of rafters 48 at the upper ends thereof.

Roofing panel 44 is constructed in substantially the same manner as panel 42, except that it has a lower ridge connector plate 54 connected along an edge 56 of the plurality of rafters 58 which extend the length of panel 44 and are substantially parallel to one another. The lower ridge connector plate 54 is fixedly disposed along rafter edges 56 at a predesigned distance commencing below ridge connector plate 50 designated 60 which substantially equals the height of upper ridge connector plate 50. Both these panel sections are prefabricated at an off-site factory and are tested for ready and accurate assembly before being transported to the construction site. As shown in FIG. 3, the assembled panels from the top of said ridge of roof 40.

To continue with the description of roof 40, reference is made to FIG. 5 where an extension of roofing panel 44 is shown. For the sake of brevity, only one side of roofing panel 44 is shown. It should be noted that panel 42 is a mirror image of 44 in the lower section shown in FIG. 5. As shown in FIG. 5 a wall panel 62, a ceiling panel 64 and roof panel 40 are disconnected from one another. As can be seen in FIG. 5 the rafters 58 extend the full length of the roof panel and substantially parallel to one another. The rafters 58 are covered along their outer edges by sheating material 46 which extends a preselected distance beyond rafter 58. It should be noted that no additional roofing materials is shown in the drawings but it is to be understood that such material is optionally applied at the site or in the factory.

Near the lower end of rafters 58 there is a cut-out generally designated 66 of a predesigned configuration in each rafters 58. A key board 68 is fixedly connected to said plurality of rafters 58 along the cut-out edge section 70 of rafters 58. It should be noted that key board 68 is fixedly connected to cut-out edge section 70, but is disposed near the edge and that the distance designated A equals the dimension W of a lock board 72 which is part of ceiling panel 64. A roof panel connector plate 74 is fixedly connected on one side to a cut-out edge 76 which forms part of the overall cut-out edge 66. The other side of plate 74 is in alignment with another cut-out 78. Thus, the roof panels 44 are completed and ready for ridged connection to ceiling panel 64.

Continuing with the description, ceiling panel 64 includes a plurality of ceiling panel joists 82 which extend substantially parallel to one another, a lock board connector 72 fixedly attached along an upper ceiling joist edge 84 of ceiling joists 82, a ceiling band joist connector 86 fixedly connected along another edge of joists 82 and to lock board 72. A ceiling panel connector plate 88 is connected along a lower edge section 90 of joists 82 and a wall covering material 92, such as wall board, for example, which extends to cover all panel joists to thereby complete ceiling panel 64. It should be noted that connector plate 88 extends beyond the end of joist 82 a distance equal to width of 86 as shown in FIG. 5. An S-shaped line 91 represents insulation material disposed in the ceiling panels.

The wall panel 62 includes a framework consisting of a top stud connector plate 94, a bottom stud connector plate (not shown in FIG. 5) and a pair of end stud connectors (not shown in FIG. 5) which are ridgedly and fixedly connected to said top and bottom stud connector plates. The wall panel may have a plurality of interior framing members connected to said top and bottom stud connectors and being disposed substantially parallel with said pair of end stud connectors. Fixedly connected to said top stud plate 94 is a top wall panel connector plate 96 which is coextensive with said stud connector plate 94. Either side of open framework of said panel 62 is covered by a wall covering material 92, such wall board for the interior side, and exterior plywood sheating for the other side.

The interior of the wall is made advantageously to include a weather insulating matrial 110 as shown in FIG. 6 by the multiple length S-shaped line.

Also shown in FIG. 5 are several additional members in the construction system enable the connections between the three panels to produce a conventional building in appearance which are in keeping with the inventive concept disclosed herein for the use of panelized pre-engineered elements for rapid and ease of assembly, disassembly and reassembly. The elements shown are a fascia board 98 which is connected to a vertical edge 100 of said plurality of rafters 58, a plurality lockout members 102 which are selectively connected to one or more of said rafter 58 long the entire length thereof, a sofit member 104 and a support strip 106. All of which are site applied components which necessarily need not be prefabricated.

Referring now to FIG. 6, the wall panel 62, ceiling panel 64 and roof panel 40 are depicted as assembled. In FIG. 6 as can be readily seen, the erection and assemble of these three panels is accomplished. More specifically, roof panel 44 and ceiling panel 64 are assembled simply by the use of lock board connector 72 and key board connector 68 to form a substantially rigedly fixed interlocking arrangement there between. At substantially the instance the connections between elements 72 and 68 are made a second connection between the panels is commenced and is completed by the insertions of a plurality of bolts 114 specifically selected to hold roof panel plate 74 firmly in contact with ceiling band joist connector 86. As it can be seen in FIG. 5, lock board connector 72 fits into an effective mechanical key-way formed by the cut-out section 70 and the second cut-out edge 78 both being formed in each of said plurality of rafters 58.

The formation and presence of these key-ways in each rafter member 58 is one of many unique features of the present invention which makes construction and assembly or disassembly advantageous over prior art systems and techniques. To continue, it can readily be understood and appreciated by those versed in the architectural-engineering art, that the present positioning of the rafter at their disclosed location and with the design configuration, the downward weight of the roof panel alone is adequate to hole it in ridge fixed position while resting on the edge of the ceiling panel. The ceiling panel is in turn, vertically supported by wall panel 62. However, further ridigity and strength are added to the jointures owing to the fact that a plurality of appropriate bolts 114 are utilized to provide added mechanical strength and support to the system spaced periodically all along the entire length of the roof panels. It has been found in experimental investigations of the present arrangements that they are architecturally sound meeting the building code requirements and architectural-engineering design specifications and design criteria for contemporary building. State more succinctly, "the form follows the function."

Referring again to FIG. 6, the ceiling panel 64 and wall panel 62 are ridgedly secured to each other through the use of ceiling connector plate 88 and top stud connector plate 94 with the aid of a plurality of bolts 108 which are spaced periodically along the length of these panels. Having completed the major connections between the three panels the remaining elements 98, 102, 104, and 106 are affixed to the roof system to provide additional support and rigidity to the structure.

It should be noted that while the system has been described with reference to FIG. 6, only one half of roof, ceiling and wall combination has been depicted and discussed in the interest of brevity.

Referring now to FIG. 7 there is shown an assembled arrangement between a typical interior wall panel 62, and two floor panel sections 116 and 118 which are setting on a support pier or column 120 that is in turn setting on a footing 122. The latter two members constitute a part a foundation system for supporting the entire building structure. The assembled connection shown in FIG. 7 is shown again in FIG. 8 unassembled to illustrate the archetectural and engineering features of the cooperating mechanical arragement provided in the adjoining edge regions of panels 62, 116 and 118.

The juncture mechanisms at the edge region of floor panels 116 and 118 are similar. The connection members of panel 116 comprises a full panel girder member 124, which extends the full length of one dimension of panel 116 and is connected to each of a plurality of substantially parallel joist members 126 which extend substantially perpendicular to full girder member 124 and another dimension of panel 116. Joists 126 are connected to girder 124 along an edge 128. Also connected to joists 126 is a joist bracing connector plate 130 which is also connected to girder 124. Bracing plate 130 is dispssed in a cut-out notch 131 of joist 126, said cut-out notches are cut into each of said plurality of joists 126 so as to receive plate 130 in a snug fit. These three members 124, 126, and 130 are all tied together by a flooring material covering 132, which provides additional mechanical strength to their juncture. The flooring material covering 132 may be a combination of conventional subflooring and underlayment materials used in the construction trade. The connection for the adjoining edge region of panel 116 is completed by the connection of a positioning plate 134 which may be also characterized as a one half size girder member, because in the completed assemblage of the juncture connection it forms the upper portion of a third middle girder.

Figure 8:
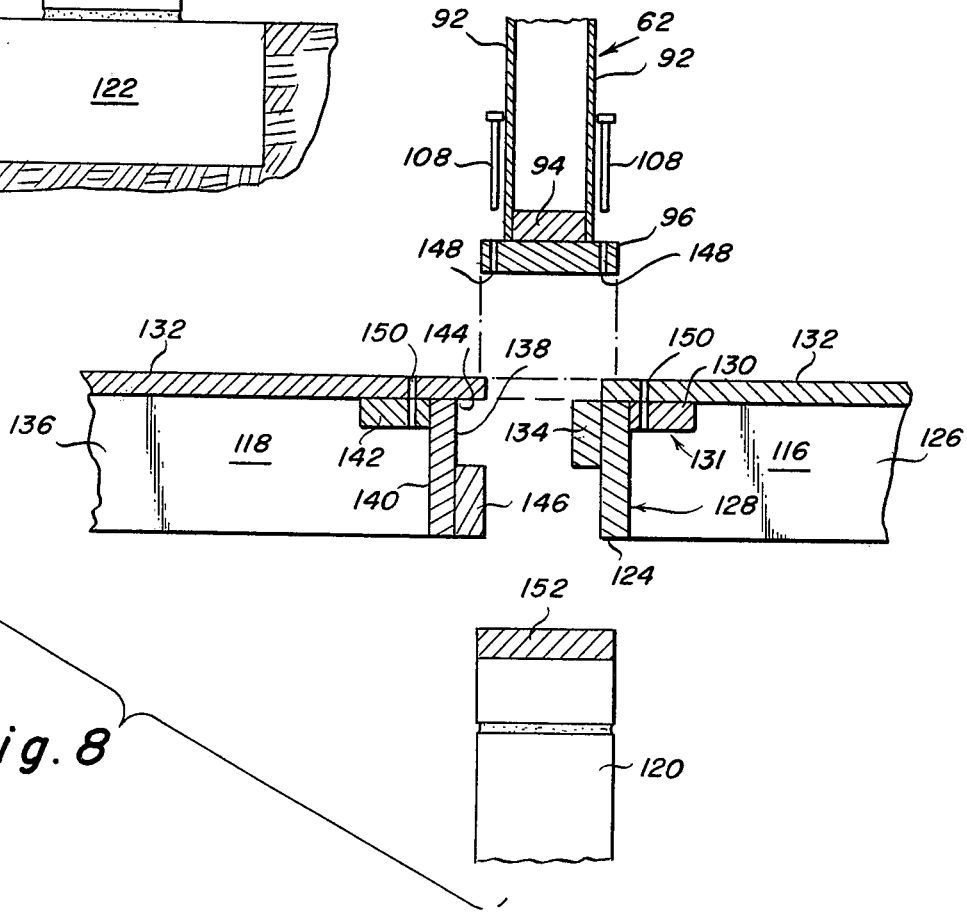
FIG. 8 is the same fragmentary view of the house shown in FIG. 7, except that the elements of the figure are disassembled.

To continue with the description of FIG. 8, reference is made to panel section 118. Panel 118 is constructed in the same manner as panel 116, having a second plurality of substantial parallel disposed joist members 136 extending along one dimension of panel 118, each being connected by a full girder member 138 along intersection line 140 of joist 136 and girder 138. A bracing plate 142 which is identical in configuration, location and function as bracing plate 130 is connected to joist 136 and girder 138. Once the three members 136, 138, and 142 are connected they are then interconnected by flooring material 132. As shown, panel 118 differs from panel 116 in two respects. First, the flooring material 132 of panel 118 extends a distance, shown as 144, beyond girder 138 and is equal in dimension to the width of positioning plate 134. Secondly, panel 118 has a positioning plate 146, also characterized as a lower half size girder, which is complementary to the upper half girder plate 134.

With both panels 116 and 118 completely prefabricated as described they are ready for connection with an interior wall panel 62 which has been previously described in connection with FIGS. 5 and 6. As shown in FIG. 8, wall 62 includes a bottom wall panel connector plate 96 connected to a stud connector plate 94 and a wall covering material 92. A plurality of apertures or holes 148 are drilled through bottom wall panel connector plate 96 at pre-designated intervals to receive a series of bolts 108. A similar complementary series of apertures 150 are drilled through joist bracing connector plates 130 and 142, and flooring material 132. Both of these sets of pre-drilled holes fall into predesignated alignment with corresponding holes of the respective members. Thus, when 116 and 118 are assembled apertures 150 are in aligned position with the aperture 148 and are then ready to receive bolts 108 to ridgedly secure and fix the three panels together.

After the final connection between the above three panels is made a three member girder arrangement is formed similar to that known in the prior art construction trade. It has been found that the disclosed structural arrangement of the juncture shown is architecturally as strong as conventional construction arrangements and will pass most, if not all, building code requirements for a wide range of communities.

To complete the description of FIGS. 7 and 8, reference is made to FIG. 7 where it can be seen that the assembled wall and floor panels 62, 116 and 118 are resting on support pier or column 120. Between the interconnected panels and the column 120 is a conventional bearing plate 152 and a flashing 154. In the interest of brevity the entire interior wall and floor panels have not been shown, and only those portions relating to unique connections in accordance with the present invention have been shown.

Figure 9:
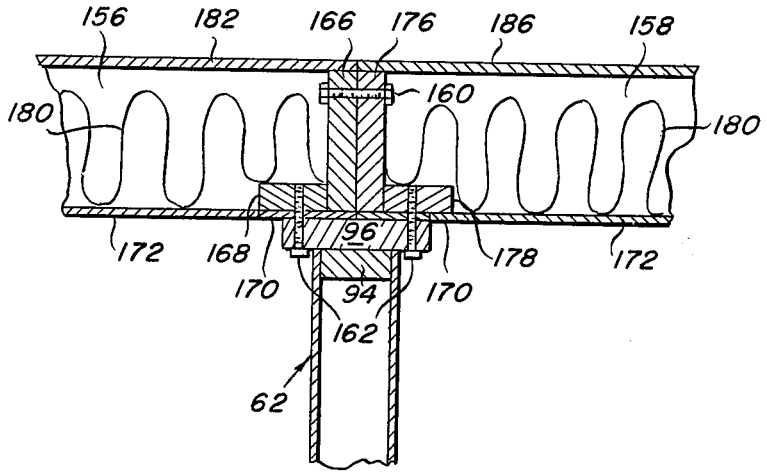
FIG. 9 is still another fragmentary view of the house shown in FIG. 1, illustrating the details of the construction and assembly connections between two ceiling panels and a wall panel.

Referring now to FIG. 9 there is shown three typical panels connected in accordance with the present invention, but which is less complicated than some previously described. As shown in FIG. 9 ceiling panels 156 and 158 connected to one another by a series of bolts 160, or other connecting devices. It is not absolutely essential that such bolts or connectors be utilized, since the two ceiling panels will be held in their sandwiched arrangement owing to the fact that the other remote ends of the panels (not shown for brevity of description) are in ridge secured relationship with one or more other panels. The wall panel 62 is connected to panels 156 and 158 through the use of a plurality of lag bolts 162.

Figure 10:
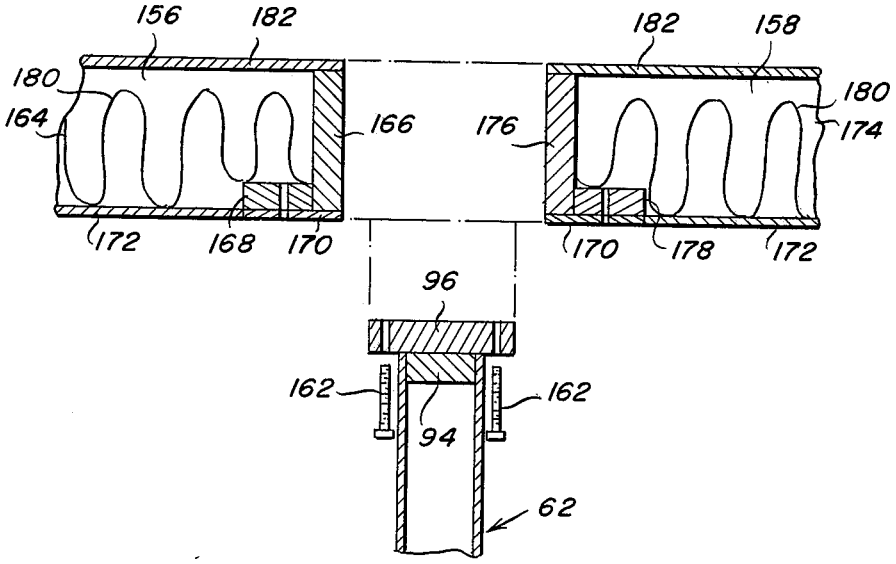
FIG. 10 is the same view shown in FIG. 9, except that the elements of the figure are disassembled.

Referring to FIG. 10, the details of the cooperating mechanical arrangement provided in the adjoining edge regions of each panel can be seen clearly. The end region of panel 156 has a plurality of ceiling joists 164 connected to a ceiling band joist connector 166 and a ceiling connector plate 168. The elements 166 and 168 are covered with a ridged and mechanically strong material 170, such as plywood, while the remainder panel framework of the ceiling is lovered with material 172 which may be gypsum wallboard, for an example. Panel 158 is constructed in a similar manner as panel 156, consisting of ceiling joists 174, ceiling band joint connector 176, ceiling connector plate 178. Each of these panels may be completed by the insertion of optional insulation materials 180 and attic flooring material, such as plywood for an example.

Figure 11:
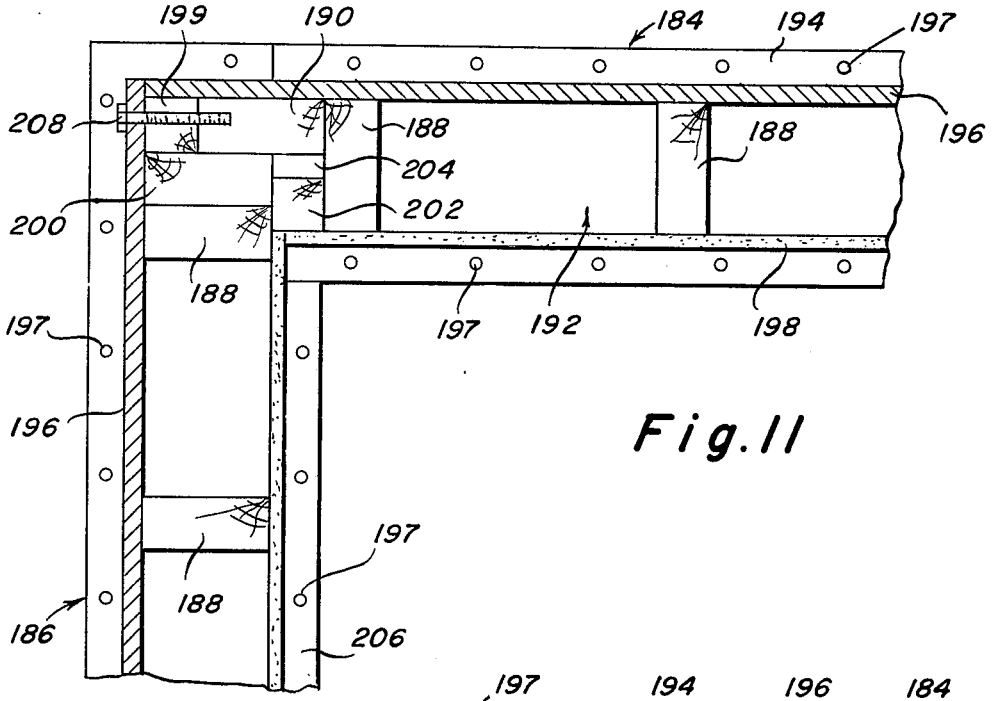
FIG. 11 is a fragmentary view of the house floor plan shown in FIG. 2, illustrating the connection between the two panels at a corner of the house shown in FIG. 1.
Figure 12:
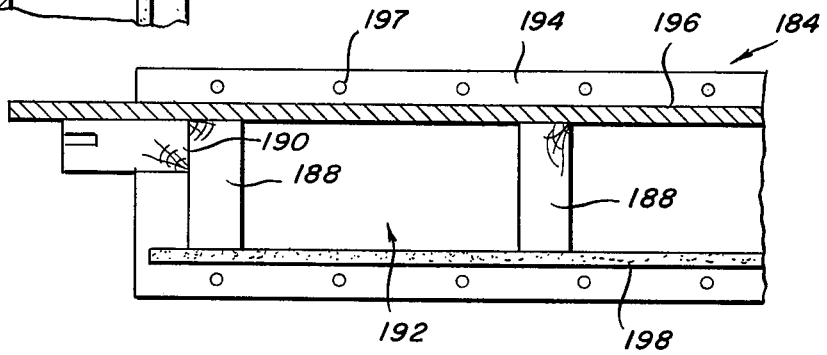
FIG. 12 is the same view shown in FIG. 11, except that the two panels are disassembled.
Figure 12:
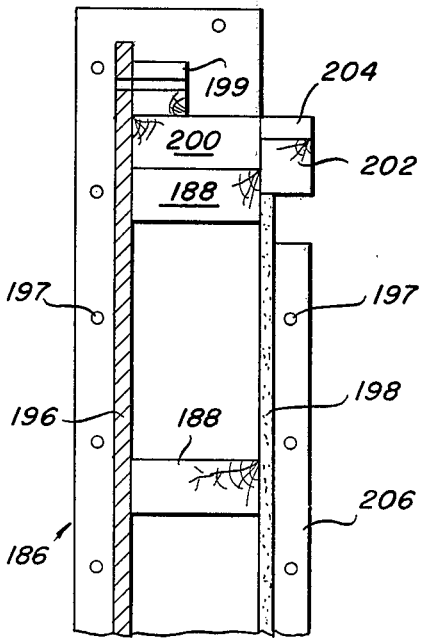

Referring now to FIGS. 11 and 12, there is shown another cooperating mechanical arrangement provided in the adjoining edge of partition or wall panels in accordance with another embodiment of the present invention whereby said panels are ridgedly secured in fixed spaced relationship with one another to form a corner connection.

The arrangement shown in FIGS. 11 and 12 includes two wall panels 184 and 186. Panel 186 includes a plurality of vertical stud members 188 spaced apart and disposed substantially parallel to one another along the length of the panel. Only a short cross-sectional view of each of these panels is shown in the interest of brevity in the description and in the size of the drawings. In panel 184 an abutment connection is made between the end stud and a vertical bracing stud member 190 in a perpendicular spaced relationship. Both the stud 188 and the bracing stud 190 are connected at their upper ends by a stud connector plate, like member 94, previously described but not shown here, and a stud connector plate 192 similar to element 94 at the lower end of the studs 188. These stud connector plates are in turn connected to an upper wall panel plate (not shown) and a lower wall panel plate 194. The elements 188, 190, 94, (not shown) and 192 constitute the framework of this panel. It is understood that studs 188 and bracing stud 190 extend substantially the full height of the panel while the studs 188 are spaced apart along the length of the panel. The framework of the panel is covered with an appropriate material. If the panel 184 functions on one side as an exterior wall, exterior sheathing or plywood 196 may be used as the covering, as an example, while the interior covering surface 198 may be gypsum wallboard.

As shown in the drawings a plurality of holes 197 are depicted in the wall panel plate 194 for interconnecting the wall panel with a flooring panel at the lower end of the panel. While holes in the upper wall panel plate (not shown) may be used to connect the wall panel to an associated ceiling panel.

To continue the discussion of FIG. 12 the connection between panels 184 and 186, form a typical corner connection as disclosed by this invention panel 186 also has a plurality of stud members 188 which have the same configuration and are connected and function as the studs in panel 184. Panel 186 has a double connected stud arrangement in the adjoining end region for additional support and strength in the resulting juncture.

Connected to the wide outward exposed surface length of a stud 200 is a half stud or nailer stud 199. This nailer stud 199 is used to form a connection with bracing stud 190 of panel 184 and the panel covering material 196 of panel 184. Also connected to element 200 is a second nailer or half stud member, 202, it is also connected along the adjacent end stud 188. Connected to elements 200 and 202 is a strip of structural filler material 204. This filler or spacing material is a furring strip and flexible which is used to provide flexible ridgity within the joint when completed. The framework of panel 186 is covered as is panel 184 on the exterior side by covering material 196 and on the interior by covering material 198. The panel is also provided with a plurality of holes in a wall panel connector plate 206.

As shown in FIG. 11, the two panels 184 and 186 form a cooperating mechanical arrangement by use of a series of spaced lag bolts 208 passed through half stud 199 into bracing stud member 190. Other forms of devices such as nails for example, may be used instead of lag bolts. However, the use of a readily removable device such as a lag bolt may be desireable when disassembly of the building structure in accordance with the present invention is contemplated at the time of initial erection.

It should be noted that half stud member 202 and the furring strip 204 fits snuggly into a cavity formed by elements 190, 188 and an extension to interior wall covering 198. Additionally fixed ridgity and strength is added to the joint when each of the panels are connected at the respective top and bottom wall panel connector plates. It has been found that the design as depicted in FIG. 12 is capable of meeting the architectural design criteria for building structures of the type envisioned by the present invention. In addition the structural arrangement depicted is understood to meet a wide range of building code requirements of various communities.

Figure 13:
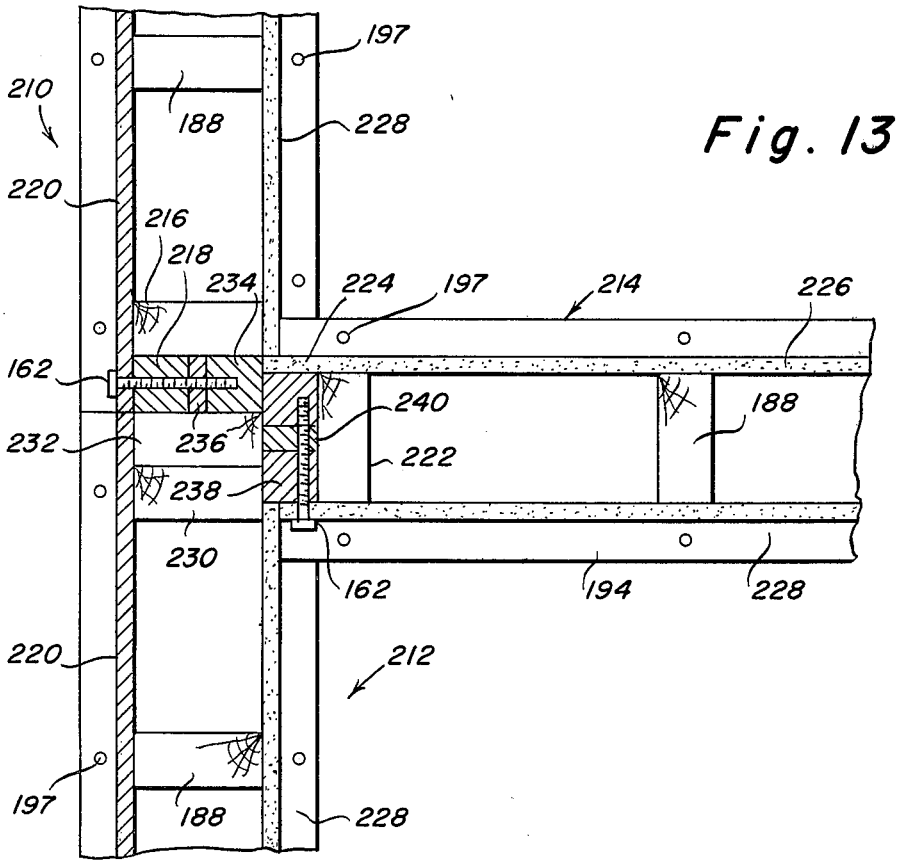
FIG. 13 is another fragmentary view of the house shown in FIG. 1, taken with reference to the house floor plan shown in FIG. 2, illustrating the assembly connection between two exterior wall panels and an interior wall panel.
Figure 14:
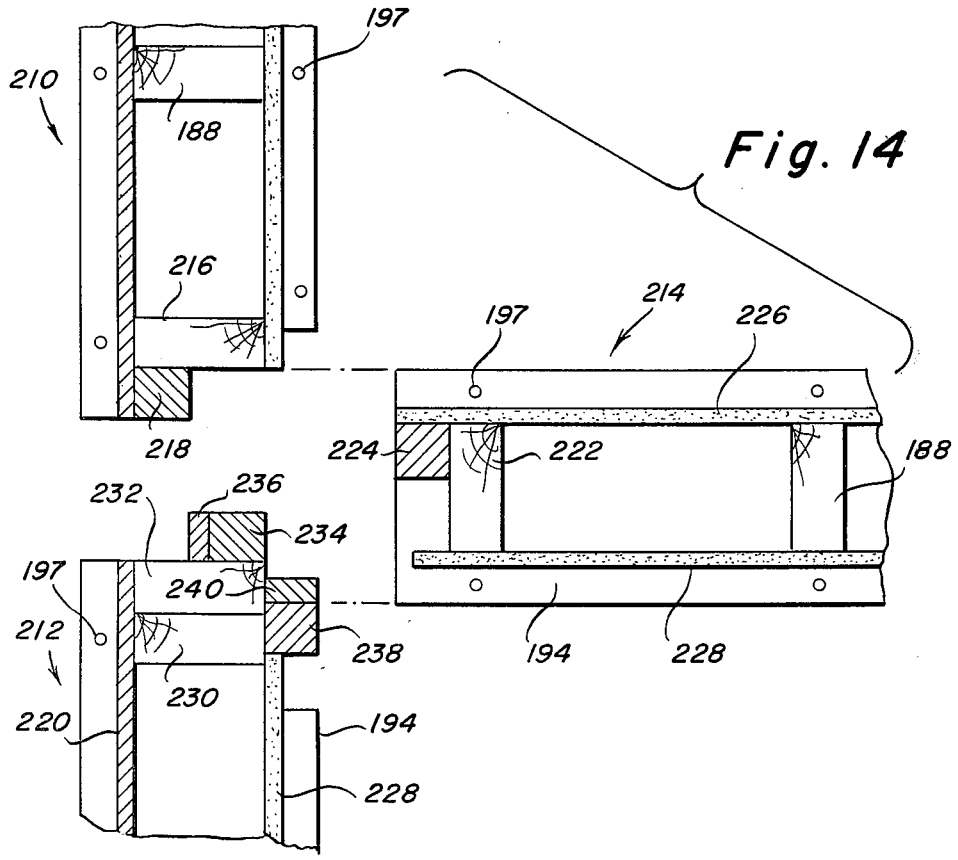
FIG. 14 is the same view as that shown in FIG. 13, except that the panels are not connected to one another.

Referring now to FIGS. 13 and 14 another embodiment of the invention is depicted by the mechanical connecting arrangement between wall panel structures 210, 212, and 214, where only a portion of each panel is shown in interest of brevity. The main body of each of these panels is built in much the same way other panels discussed hereinabove, for example in connection with FIG. 12 panel 184 or 186. The primary difference in the various panels is the manner in which the adjoining edge region of each of said panel is constructed to provide ridged fixed and secureably disposed panels.

Panels 210 and 214 are constructed similarly in that their adjoining edge regions include an end stud 216, a half stud 218 connected co-extensively to exposed end of end stud 216. Half stud 218 is also covered by an exterior or interior material 220. Referring to panel 214 a similar arrangement exists, namely an end stud 22 is connected coextensively along its exposed end to half stud 224 both of which are covered by material 226 along their respective lengths. The other side of the framework for both panels is covered with an appropriate covering material 228. Panel 212 has in its adjoining edge region two studs 230 and 232 connected parallel to one another. To the wide exposed side of 232 a half stud 234 is connected coextensively therealong. Connected to half stud 234 is a strip 236 of filler material. Along the narrow exposed edges of studs 230 and 232 another half stud and a second strip of filler material 240 are connected coextensively with the studs 230 and 232. One side of the framework for panel 212 is covered with material 220 while the other side is covered with material 228. As described previously with respect to other panels, panesl 210, 212 and 214 are provided with wall panel connectors 194, having holes 197 therein to permit bolting down where prescribed.

Panels 212 and 214 are first innerconnected and then panel 210 is inserted into the combination to complete the juncture between the three panels. As shown in FIG. 13 the completed assembly of panels is secured in ridge fixed space relationship with the additional aid of a plurality of spaced apart lag bolts 162 on the side along the height of the panels passed through covering 220 half stud 218, filler strip 236 and into half stud 234; while a second series of lag bolts 162 pass through covering 228 half stud 238, filler strip 240 into half stud 224. As has been observed with respect to the other juncture arrangements, the juncture shown in FIG. 13 is architecturally sound and adequate to meet building code requirements of most communities.

Referring now to FIG. 15, there is shown a utility panel 36, the construction details will be described in greater detail with reference to FIG. 16. The utility panel has an inner panel cavity 241 wherein a plumbing system is illustrated by a waste-vent pipe 242 disposed near one wall having several outlet pipes 244. These outlet pipes may typically be used for connecting fixtures such as face basins, bath tubs and the like for bathrooms or for sinks, washing machines, dish washers and the like for the kitchen.

In the interest of brevity and as an illustration only, the description of the utility modules will be limited to its plumbing. However, it is to be understood that the scope of the present invention is not to be limited to the plumbing for utility service, but may include the electrical wiring, heating and air conditionings ducts, etc.

Continuing with the description of FIG. 15, there is shown two water piping arrangements 246 and 248, which may be used for hot and cold water. These two water lines are connected to a plurality of outlet lines 251 on either side of the module 36 which extend through the walls 250 and 252 so that fixtures for both bathrooms and kitchens may be connected.

Referring next to FIG. 16, utility module 36 is shown as having a framework which includes a plurality of spaced apart substantially parallel studs 254, a pair of end corner studs 256 consisting of several studs connected together at the four corners of the framework of panel 36, a pair of bracing stud members 258 interconnecting said group of struds 256 at each end of the framework, end stud connector plates 257 connected to ends of said group of connected studs 256 and to a parallel pair of stud connector plates 260 which extend the entire length of panel 36 and which are also connected to co-extensive panel connector plates 262 and finally a pair of end panel connector plates 264. The framework is covered with a material 266 to complete an enclosed panel.

Several of the water pipe outlets 251 are shown with their ends extending through the panel covering 266, also shown are several outlet pipes 244 which are connected to the waste-vent pipe 242 which is disposed within cavity 241 the interior of the panel. During the construction of a building such as that shown in FIG. 1 the module 236 is set in place according to a building plan such as that shown in FIG. 2. The core 36 may be characterized as a building sub-system, of non-load bearing character from the building system support point of view. To fix the module in place a series of bolts, nails, screws or the like may be utilized by providing a series of preformed or drilled holes along the perimeter edge of panel connector plate. Another series of holes corresponding to those in the connector plate may be predrilled at the factory in the cooperating and support floor panel upon which the module sets. Once the core is set in place and fastened down the utility pipes, such as water and wastes-vent, may be connected to a prepared set of utility connections brought into the building from a commercial source.

Figure 17:
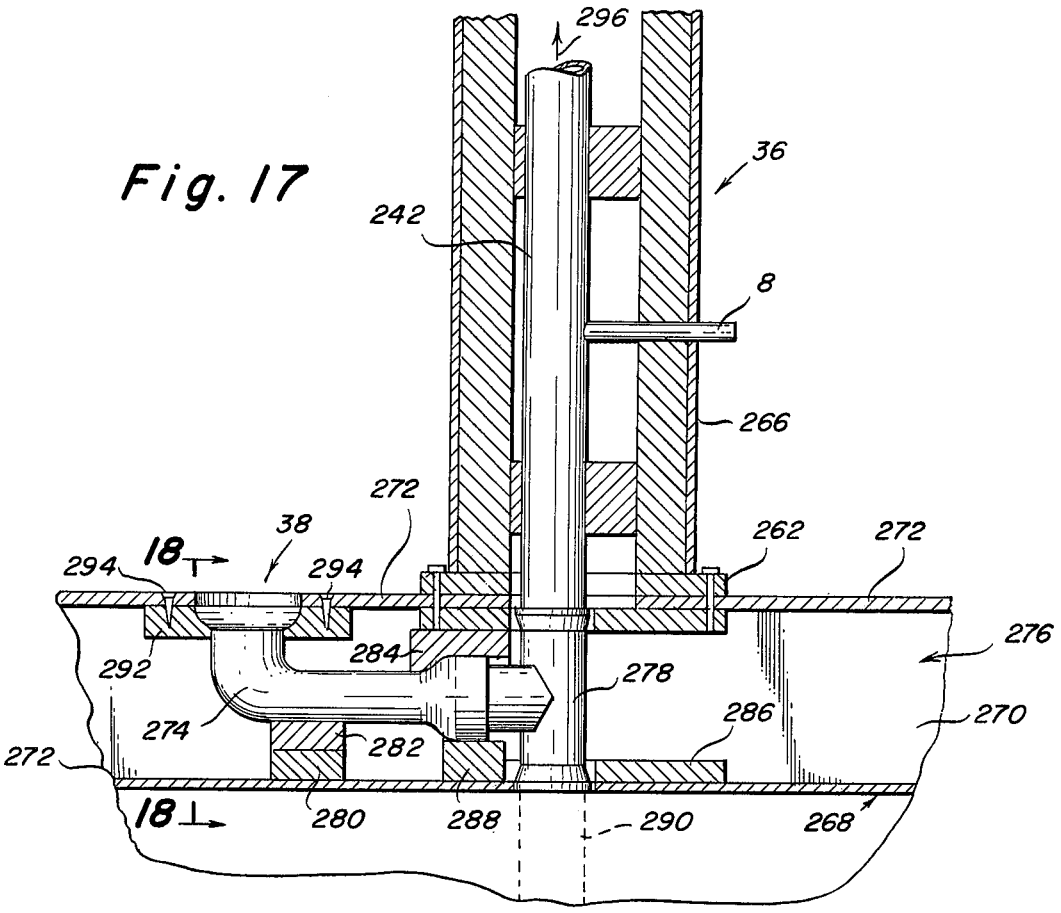
FIG. 17 is a fragmentary view of the house shown in the floor plans of FIG. 2 illustrating in greater detail an example of the interconnecting plumbing between several utility modules.

It should be recognized that the module or utility panel embodiment of this invention is not limited to interior wall-like panels, but may be applicable to other panels, such as floor panels for example. Such an embodiment may be seen with reference to FIGS. 17 and 18. In the fragmentary view of FIGS. 17 and 18, the waste-outlet 38 of FIG. 2 may be seen.

A typical utility wall core 36 is seen connected in place to a utility floor module 268. Floor core or module 268 includes a plurality of joists 270 which extend the length of the panel. The top of said joists may be covered by an underlayment floor covering at the prefabrication factory which may consist of traditional flooring materials. The bottom edge of the joist 270 may also be covered with a floor covering material. It is desireable to cover the panel 268 on its underside in the areas where the utility services reside. Such covering materials are useful as a way of hiding the utility pipes and to provide means for helping to support such pipes.

To continue, an L-shape or elbow pipe 274 is disposed within a cavity area 276 of floor module 268, and is connected to a T-shaped pipe 278. These two interconnected pipes are supported by appropriate blocks such as blocks 280, 282, 284, 286, and 288. The upper end of T-shaped pipe 278 is connected to the lower waste end of waste-vent pipe 242, while the lower end of the T-shaped section 278 may be connected to a pipe 290 which may be a portion of a waste, sewage system. L-shaped pipe 274 is further supported by a collar member 292 which encompasses the open end of the pipe designated 38. The collar is connected to floor covering 272 by a series of sunken screws 294 to provide ridge support. T-shaped section 278 is connected at its upper end to the lower end of wastes-vent pipe 242 and is vented to air as indicated by arrow 296 in normal construction.

Figure 18:
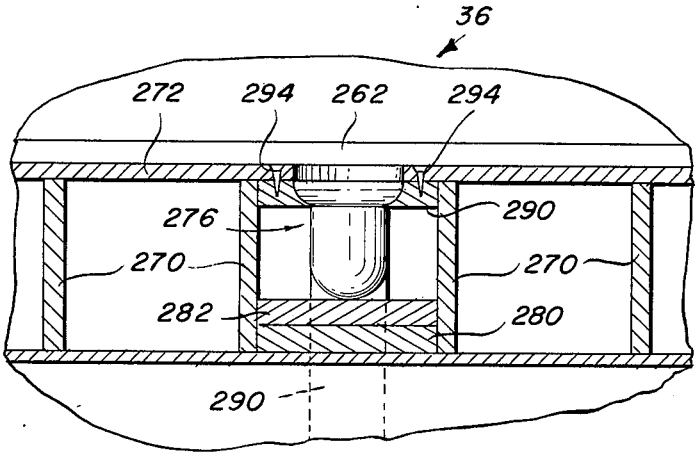
FIG. 18 is a view of FIG. 17 taken at lines 18—18, illustrating the relative position of the plumbing and certain structural elements of a floor panel.

As shown in FIG. 18 pipe 274 may be seen taken along line 18—18. The dotted joist girder member is shown to illustrate the formation of an enclosed area 276 in the panel but is not actual in FIG. 17, so that no such joist would be seen when taken from line 18—18. In a housing environment the opening 38 leading into pipe 274 may be utilized for toilet closet waste outlet in a bathroom in the house illustrated in FIGS. 1 and 2.

Thus, it can be seen that the module core panel concept is of practical use in the various panels whether wall, floor, ceiling or roof depending upon where the designer may decide to use such a module panel unit.

While the various embodiments of the present invention have been disclosed in general terms with regard to types of material, wood is a preferred material. It should be noted that the invention as disclosed encompasses all materials which may be readily adapted for use in accordance with the teachings of the present inventive concept. Such materials may include composition wood products, aluminum, aluminum composition, plastics and the like so long as they are useful in off-site factory prefabrication manufacturing methods and techniques. As a further example of the scope of the present invention, the manner of connecting the various member one to the other has been in general terms. It is envisioned by this invention that such members and/or materials may be connected by means of nails, screws, wooden pegs, welding, brazing, metal stapling, cementing and the like.

The various advantages of the present invention are readily seen and understood by those versed in the building construction art as he reads and examines the specification, drawings and claims. Some of the advantages stated briefly are, the reduced cost of manufacturing prefabricated panels or walls, flooring, ceilings and roofs which are readily understood and seen. However, the scope of the invention encompasses modules such as dormers and staircases. It also encompasses panels which are substantially complete on the interior and exterior, thereby substantial reducing if not eliminating the need for interior or exterior finishing at the building site.

Still a further advantage is derived from the present invention by reducing or eliminating the need to protect and care for materials and tools conventionally stored at a building site for extended periods.

Yet a further advantage of the present invention is derived from the fact that the system disclosed is readily assembled or reassembled owing to simplicity of the connections disclose and the absence of a need to use high cost personnel to do the assembly or disassembly work.

The present invention may be embodied in other specific forms without departing from the scope, spirit or essential attributes as disclosed in the specification, depicted in the drawings or defined in the claims. Although various features of the building construction system have been described and illustrated in the accompanying specification, drawings and claims, it is emphasized that the invention is not necessaryily limited to such and should be given the broadest application inherent within the scope and spirit of the invention.

I claim:

1. A building structure having a plurality of panels of prefabricated engineered architectural configurations assembled and erected in accordance with a preselected arrangement with one another to form a integral structure of ridgedly secured panels in fixed spaced relationship with one another wherein said plurality of assembled panels may be readily disassembled and reassembled, the combination, comprising:

a. at least two roof panels connected to one another by an upper ridge connector plate of one panel and a lower ridge connector plate of another panel at a selected adjoining edge of said panels for securing said panels to one another in abutting relationship to form a roof ridge joint, and a second roof means remote from said ridge joint for mechanically interconnecting said roof panels to other panel members of said building structure;

b. at least two ceiling panels connected to one another by means of pre-formed mechanical-configurated structures in selected adjoining edges of each panel to form an interconnecting joint therebetween by the connection of said pre-formed structures thereby forming a ceiling of said building structure, said ceiling panels having along other selected edges thereof a lock board connector arrangement for an interlocking connection with said second roof means to thereby complete a mechanical interconnecting arrangement between said roof and ceiling panels for structural support of said roof;

c. a plurality of interior and exterior wall panels each having horizontal and vertical edges being connected to one another along selected vertical edges by means of pre-formed mechanical configurated structures in selected adjoining edges of each panel to form a mechanical interlocking joint therebetween by the connection of said preformed structures thereby securing said panels to one another to form abutting or corner wall joints of said building structure;

d. a plurality of floor panels connected to one another by pre-formed mechanical configurated joist bracing connector plate means in selected edge regions of each of said panels for fixed securing and mechanical interconnecting said panels to one another to form a floor for said building structure for structural support said roof, ceiling, and wall connected panels; and e. a foundation for said building structure, said means at selected edge regions of said floor panel being further defined as forming at least one multimember structure which is disposed at pre-selected location on said foundation to thereby provide support for said foundation to thereby provide support for said interior and exterior wall panels connected to said floor along pre-selected portions of said horizontal edges of said wall panels, said roof and ceiling for said building structure are connected to pre-selected portions of said horizontal edges of said wall panels remote from said floor panels, at the respective adjoining edge regions of said walls, ceiling and rool to thereby form fixedly secured junctures therebetween whereby said plurality of interior and exterior wall members provide vertical support for said interconnected roof and ceiling to complete the erection and assembly of said building structure.

2. A building structure as defined in claim 28 wherein arrangements of said wall or floor panels further define modular structures within said building for enclosing and physically supporting plumbing pipes for a waste disposal system and being connectable to conventional sewage disposal outlets, said arrangement consists of a wall panel having an air vented pipe contained and supported therein, said air vented pipe having a terminal end thereof for physically mating with other sections of said disposal system, a floor panel arrangement having at least one section of waste disposal piping contained and supported therein, said piping having at one end thereof an opening which terminates flush with a surface of said floor panel and a T-shaped configuration at the other end thereof for receiving said terminal end of piping within said wall panel and for connection to an outlet to a conventional sewage disposal system.

3. A building structure as defined in claim 1 wherein said interconnecting and interlocking connections between said roof panels, ceiling panels, roof to ceiling panels, wall panels, roof to ceiling to wall panels, floor panels, and wall to floor panels are further defined as structional arrangements whereby said various connections may readily to disassembed and reassembled on site without disrupting or destroying the structural integrity of said building structure or said panel members.

4. A building structure as defined in claim 3 wherein said interconnecting and interlocking connections between said roof panels, ceiling panels, roof to ceiling panels, wall panels, roof to ceiling to wall panels, floor panels, and wall to floor panels are further defined as structural arrangements whereby said various connections may readily be disassembled and reassembled on site for altering the size of said building structure to reduce or increase the size of said building structure without destroying or disrupting the structural integrity of said building or said panel members.

5. A building structure having a plurality of prefabricated panels assembled and erected in a preselected floor arrangement to form a structure wherein said plurality of assembled panels may be disassembled and reassembled to accommodate and expansion or reduction in the size of configuration arrangement of the building structure without disrupting or destroying the structural integrity of the structure the combination, comprising:

a. a roof having a preselected length and width and having at least two roof panel sections connected to one another to form an apex of said roof structure and held in fixed position by means of upper and lower ridge connector plates which are connected respectively to a plurality of rafter elements of said roof panels to thereby form means of mechanically locking said panels at their adjoining edges regions in fixed interlocking relationship, each of said rafter elements extending the full length of said roof panels and being substantially paralled to one another, each of said rafters having an end remote from said roof apex with a cut-out near a lower end thereof having a pre-engineered and pre-designed configuration to which a key board and a roof panel connector plate is fixedly connected to each rafter at said cut-out to thereby link said rafters together along said preselected width of each of said roof panels to thereby form means for mechanically interconnecting said roof panels to one another section of said building structure;

b. a ceiling having at least two ceiling panel sections connected to one another along one dimension by mechanical means to form a main ceiling structure therefor, a lock board connector and a ceiling band joist connector being fixedly connected along each paralled perimeter edge of said panels along one dimension thereof and perpendicular to one another along an upper ceiling joist edge of said one dimension, said cut-out of said rafter and said key board of said roof form a slot into which said lock board connector may be fitted in interconnecting fixed relationship with said rafters and said roof panel connector plate when positioned in flush alignment with said ceiling band joist connector to thereby complete an interlocking arrangement between said roof and ceiling sections;

c. a plurality of wall panel sections having horizontal and vertical edges, two of said wall panel sections being connected with one another along their respective vertical edges to form a corner connection, said vertical edge of one of said wall panel sections consists of a vertical bracing stud member connected to a framing stud member in a perpendicular spaced relationship to form a first portion of an interlocking means of a corner connection, said vertical edge of said second wall panel section consists of a vertical framing stud member connected to one surface to a half stud member and on another adjacent perpendicular surface a second half stud member and a strip of structural filler material connected to said second half stud and said framing stud to thereby form an arrangement for receiving said first portion of an interconnecting means of a corner connection to thereby complete said connection;

d. a floor having at least two floor panel sections each having a width and length and an adjoining edge region there between extending the full length of one dimension thereof, said adjoining edges each have a full panel girder member connected to a plurality of substantially parallel joist members along another dimension of said panel, each of said panel girder members and at least two of said joist members having a joist bracing connector plate connected there between to provide mechanical strength at their junction and to provide additional means for interconnecting said floor sections with vertical wall panel sections, a positioning plate, connected to said full panel girder member and extending the full length thereof, each of said positioning plates is connected in an upper of lower position with respect to one another to thereby form an interconnecting arrangement therebetween when placed in fitted spaced relationship to one another to further form at least one structural beam member for support of said walls, ceiling and roof; and e. a foundation for said building structure for supporting said floor panels which are set on said foundation at preselected locations thereof resting on said structural beam members formed by said floor panels at said adjoining edge regions to thereby provide support for said wall panels connected to said floor along preselected portions of said horizontal edges of said wall panels, said roof and ceiling for said building structure being connected to the horizontal edges of said wall panels remote from said horizontal edges of said wall panels connected to said floor to provide vertical support for said interconnected roof and ceiling panels to complete the erection and assembly of said building structure.

6. A building structure as defined in claim 5 wherein said interconnecting and interlocking connections between said roof panels, ceiling panels, roof to ceiling panels, wall panels, roof to ceiling to wall panels, floor panels, and wall to floor panels are further defined as structional arrangements whereby said various connections may readily to disassembled and reassembled on site without disrupting or destroying the structural integrity of said building structure or said panel members.

7. A building structure as defined in claim 6 wherein said interconnecting and interlocking connections between said roof panels, ceiling panels, roof to ceiling panels, wall panels, roof to ceiling to wall panels, floor panels, and wall to floor panels are further defined as structural arrangements whereby said various connections may readily be disassembled and reassembled on site for altering the size of said building structure to reduce or increase the size of said building structure without destroying or disrupting the structural integrity of said building or said panel members.

* * * * *